US006044889A

United States Patent [19]

LIU

[11] Patent Number: 6,044,889

[45] Date of Patent: Apr. 4, 2000

[54] TENSION LIFT DEVICE FOR A VENETIAN BLIND

[76] Inventor: Tai-Ping LIU, No. 15, Alley 8, Lane 3, Kuochi St., Lungching Hsiang, Taichung Hsien, Taiwan

[21] Appl. No.: 09/317,593

[22] Filed: May 24, 1999

[51] Int. Cl.[7] ..... E06B 9/327

[52] U.S. Cl. ..... 160/172 R; 160/168.1 R

[58] Field of Search ..... 160/172 R, 176.1 R, 160/176.1 P, 168.1 R, 168.1 P, 84.06, 279, 178.1 R

[56] References Cited

U.S. PATENT DOCUMENTS

| | | | |
|---|---|---|---|
| 2,248,775 | 7/1941 | Nottingham | 160/172 R |
| 3,465,806 | 9/1969 | Sulkes | 160/84.06 |
| 4,557,309 | 12/1985 | Judkins | 160/279 |
| 4,574,864 | 3/1986 | Tse | 160/279 |
| 4,678,038 | 7/1987 | Clemente | 160/84.06 |
| 4,825,929 | 5/1989 | Haines | 160/84.06 |
| 5,082,043 | 1/1992 | Moreno | 160/84.06 |
| 5,533,559 | 7/1996 | Judkins | 160/172 R |

*Primary Examiner*—Blair M. Johnson
*Attorney, Agent, or Firm*—Thomas, Kayden, Horstemeyer & Risley, L.L.P.

[57] ABSTRACT

A tension lift device is provided for a Venetian blind which includes a headrail, a plurality of slats, and a bottom rail. The tension lift device includes a first retaining cord extending through each of the slats and having a first end secured in the headrail, and a second end extending through the bottom rail and extending outward from the bottom rail, and a second retaining cord extending through each of the slats and having a first end secured in the headrail, and a second end extending through the bottom rail and extending outward from the bottom rail.

10 Claims, 10 Drawing Sheets

TENSION LIFT DEVICE FOR A VENETIAN BLIND

CROSS-REFERENCES TO RELATED APPLICATIONS

Not Applicable.

BACKGROUND OF THE INVENTION

FIELD OF THE INVENTION

The present invention relates to a tension lift device, and more particularly to a tension lift device for a Venetian blind.

DESCRIPTION OF THE RELATED ART

A conventional Venetian blind in accordance with the prior art shown in FIG. 10 comprises a headrail (50), a plurality of slats (52), a bottom rail (55), multiple ladder cords (51), and a lift cord (56) to lift or lower the slats (52).

However, the lift cord (56) has a loop shape such that a child may unintentionally wind the lift cord (56) around its neck, thereby easily injuring the child. In addition, the slats (52) and the bottom rail (55) will freely swing due to the wind blowing, thereby creating noise. In such a manner, the slats (52) are easily tangled with the ladder cords (51) and the lift cord (56), thereby making the lift cord (56) inoperative, and wearing the slats (52). The present invention has arisen to mitigate and/or obviate the disadvantage of the conventional Venetian blind.

BRIEF SUMMARY OF THE INVENTION

In accordance with one aspect of the present invention, there is provided a tension lift device for a Venetian blind which includes a headrail, a plurality of slats, and a bottom rail. The tension lift device comprises a first retaining cord extending through each of the slats and having a first end secured in the headrail, and a second end extending through the bottom rail and extending outward from the bottom rail, and a second retaining cord extending through each of the slats and having a first end secured in the headrail, and a second end extending through the bottom rail and extending outward from the bottom rail.

Further benefits and advantages of the present invention will become apparent after a careful reading of the detailed description with appropriate reference to the accompanying drawings.

DETAILED DESCRIPTION OF THE INVENTION

Figure 1:
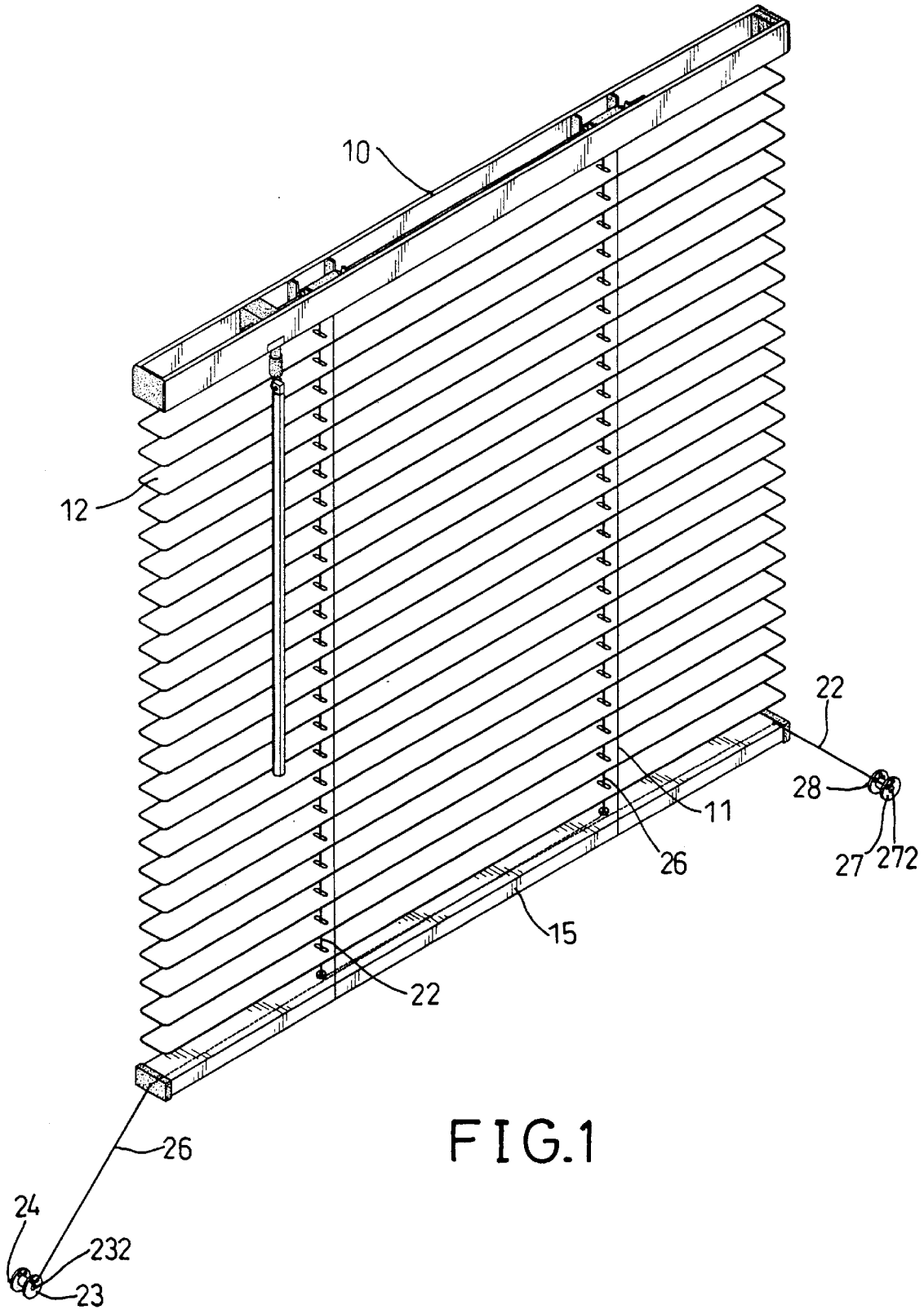
FIG. 1 is a perspective view of a tension lift device for a Venetian blind in accordance with the present invention.

Referring to the drawings and initially to FIGS. 1–4, a tension lift device in accordance with the present invention is provided for a Venetian blind which includes a headrail (10), a plurality of slats (12), two ladder cords (11), and a bottom rail (15).

The tension lift device comprises a first retaining cord (22) extending through each of the slats (12) and having a first end secured in the headrail (10), and a second end extending through the bottom rail (15) and extending outward from the bottom rail (15), and a second retaining cord (26) extending through each of the slats (12) and having a first end secured in the headrail (10), and a second end extending through the bottom rail (15) and extending outward from the bottom rail (15).

The tension lift device also comprises a first fastening reel (23) secured to the second end of the second retaining cord (26), and a second fastening reel (27) secured to the second end of the first retaining cord (22). The first fastening reel (23) contains a first axial hole (232) therein, and includes a first tapered retaining lug (24) extending outward from the periphery thereof. The second fastening reel (27) contains a second axial hole (272) therein, and includes a second tapered retaining lug (28) extending outward from the periphery thereof.

The tension lift device also comprises a first biasing member (21) having a first end secured in the headrail (10), and a second end secured to the first end of the first retaining cord (22), and a second biasing member (25) having a first end secured in the headrail (10), and a second end secured to the first end of the second retaining cord (26).

The second end of the first retaining cord (22) extends in the bottom rail (15) in the direction opposite to that of the second end of the second retaining cord (26). The bottom rail (15) has a first end and a second end, the second end of the first retaining cord (22) extends outward from the second end of the bottom rail (15), and the second end of the second retaining cord (26) extends outward from the first end of the bottom rail (15).

Figure 2:
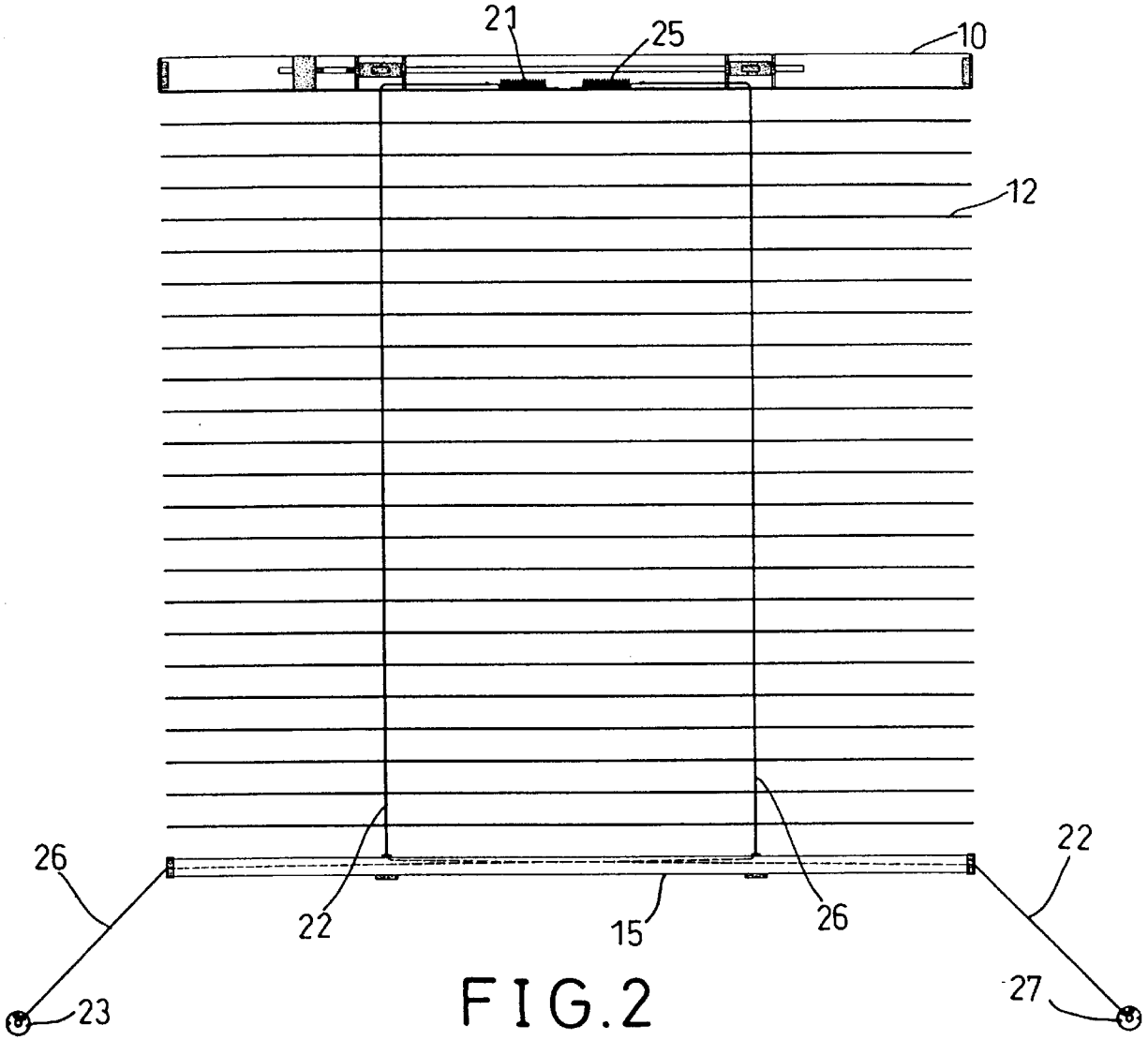
FIG. 2 is a front plan view of the tension lift device as shown in FIG. 1.
Figure 3:
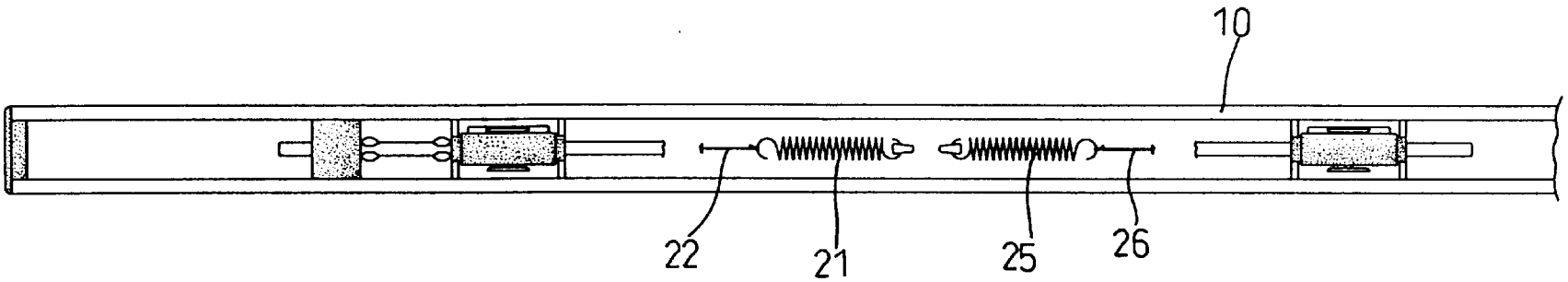
FIG. 3 is a top plan view of the tension lift device as shown in FIG. 1.
Figure 4:
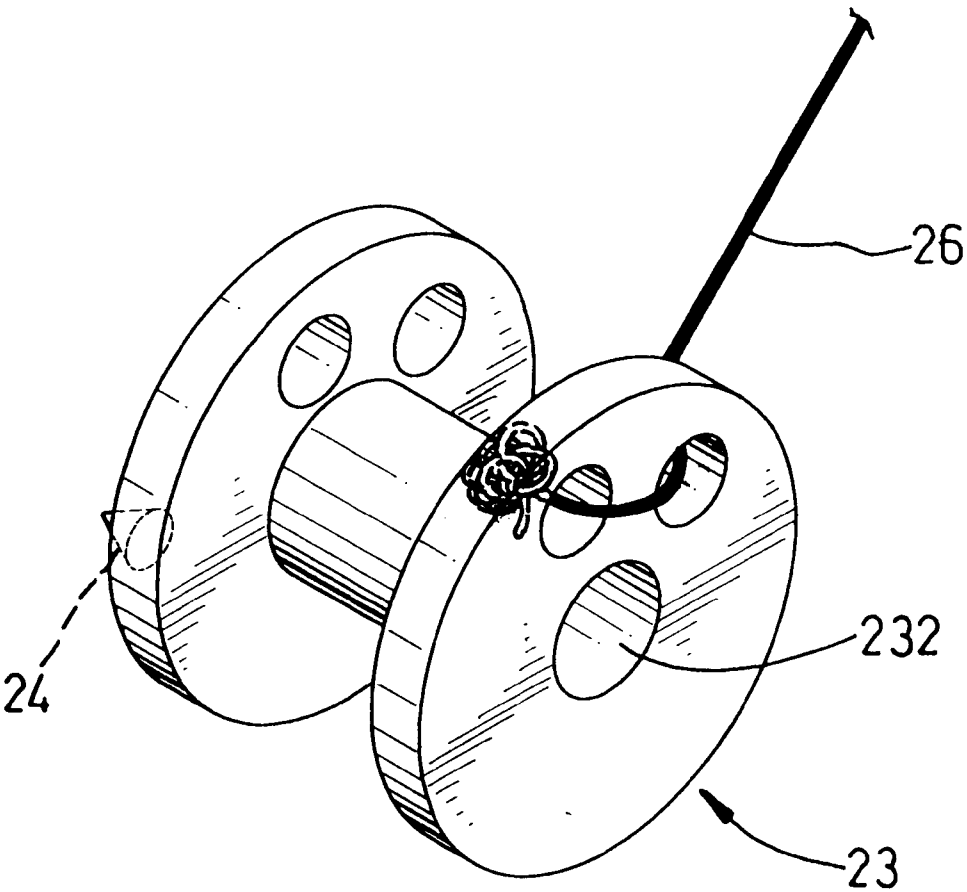
FIG. 4 is a top plan view of the tension lift device as shown in FIG. 1.

In assembly, the first fastening reel (23) is attached to a wall by means of a first fastener (not shown) extending through the first axial hole (232) to secured the second end of the second retaining cord (26) to the wall, and the second fastening reel (27) is attached to the wall by means of a second fastener (not shown) extending through the second axial hole (272) to secured the second end of the first retaining cord (22) to the wall, best shown in FIG. 2. The first retaining lug (24) inserted into the wall is used to prevent the first fastening reel (23) from rotating, and the second retaining lug (28) inserted into the wall is used to prevent the second fastening reel (27) from rotating.

Figure 5:
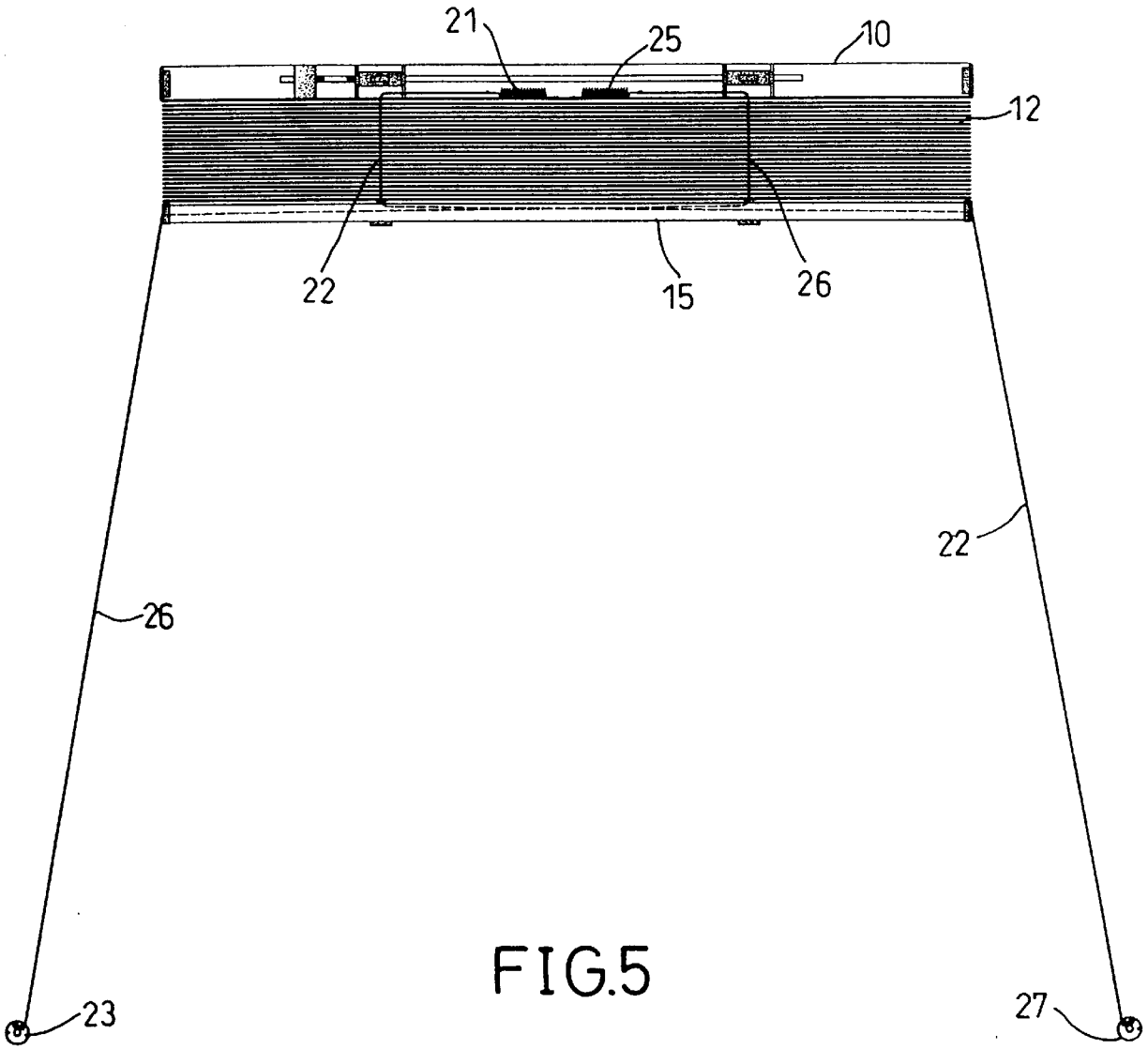
FIG. 5 is an operational view of the tension lift device as shown in FIG. 2.
Figure 6:
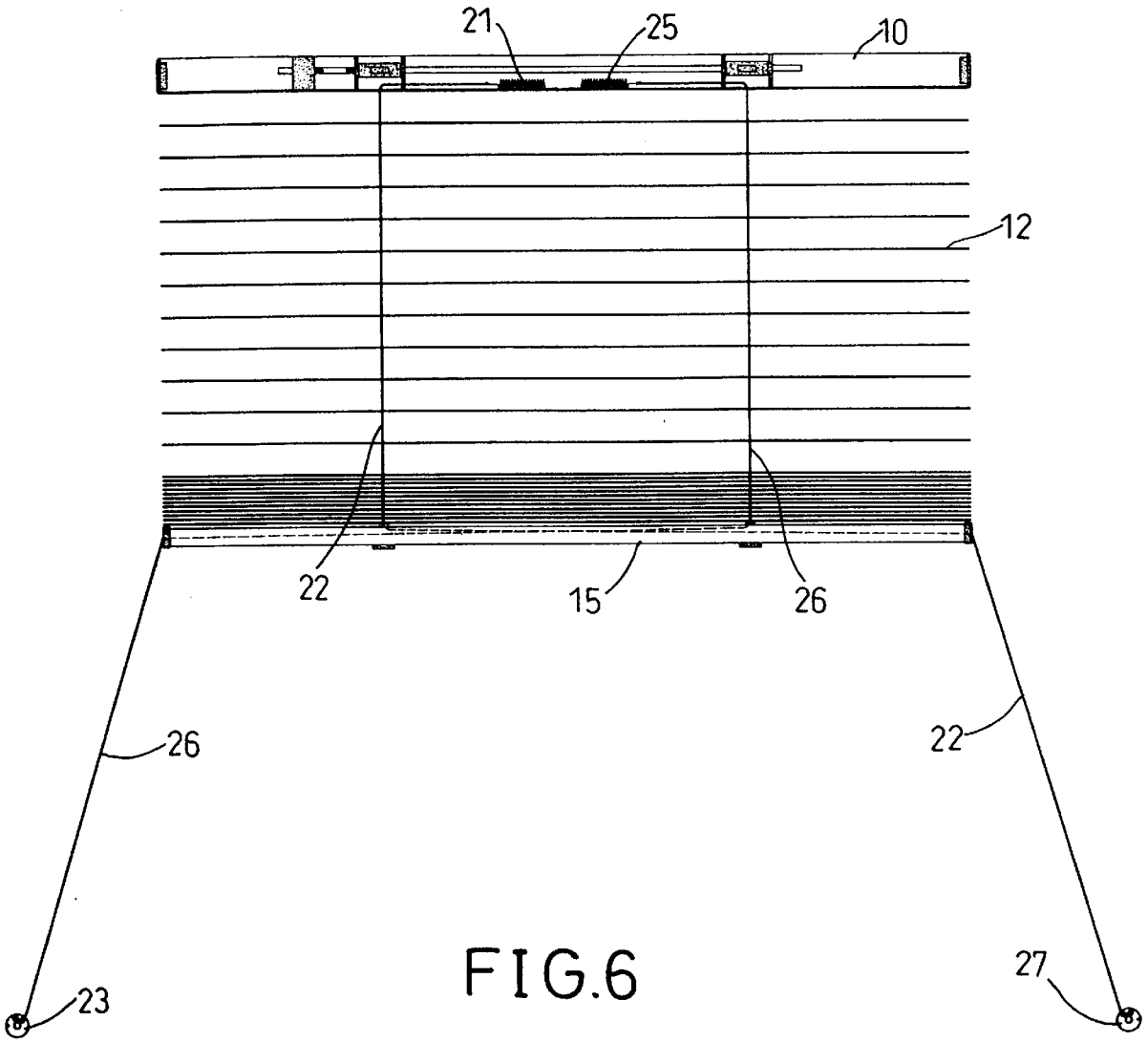
FIG. 6 is an operational view of the tension lift device as shown in FIG. 2.

In operation, referring to FIGS. 5 and 6 with reference to FIGS. 1 and 2, the bottom rail (15) can be lifted from the position as shown in FIG. 2 to the position as shown in FIG. 5, and can thus be retained in place by means of the tension exerted by the first retaining cord (22) and the second retaining cord (26) on the bottom rail (15). The bottom rail (15) can also be lowered from the position as shown in FIG. 5 to the position as shown in FIG. 6, and can thus be retained in place by means of the tension exerted by the first retaining cord (22) and the second retaining cord (26) on the bottom rail (15).

When the first retaining cord (22) and the second retaining cord (26) are too loose such that the bottom rail (15) cannot be retained in place by means of the tension exerted by the first retaining cord (22) and the second retaining cord (26), the second end of the first retaining cord (22) can be wound around the second fastening reel (27), and the second end of the second retaining cord (26) can be wound around the first fastening reel (23), thereby efficiently retaining the bottom rail (15) in place.

In such a manner, the Venetian blind can be folded by means of lifting the bottom rail (15), and can be expanded by means of lowering the bottom rail (15) such that the Venetian blind does need to be provided with a lift cord as is disclosed in the conventional Venetian blind, thereby preventing a child being unintentionally wound by the lift cord so as to assure the child's safety. In addition, the slats (12) and the bottom rail (15) are retained in place to the wall by the first retaining cord (22) and the second retaining cord (26), thereby preventing the slats (12) and the bottom rail (1 5) from freely swinging due to the wind blowing so as to prevent the slats (12) from being worn out.

Figure 7:
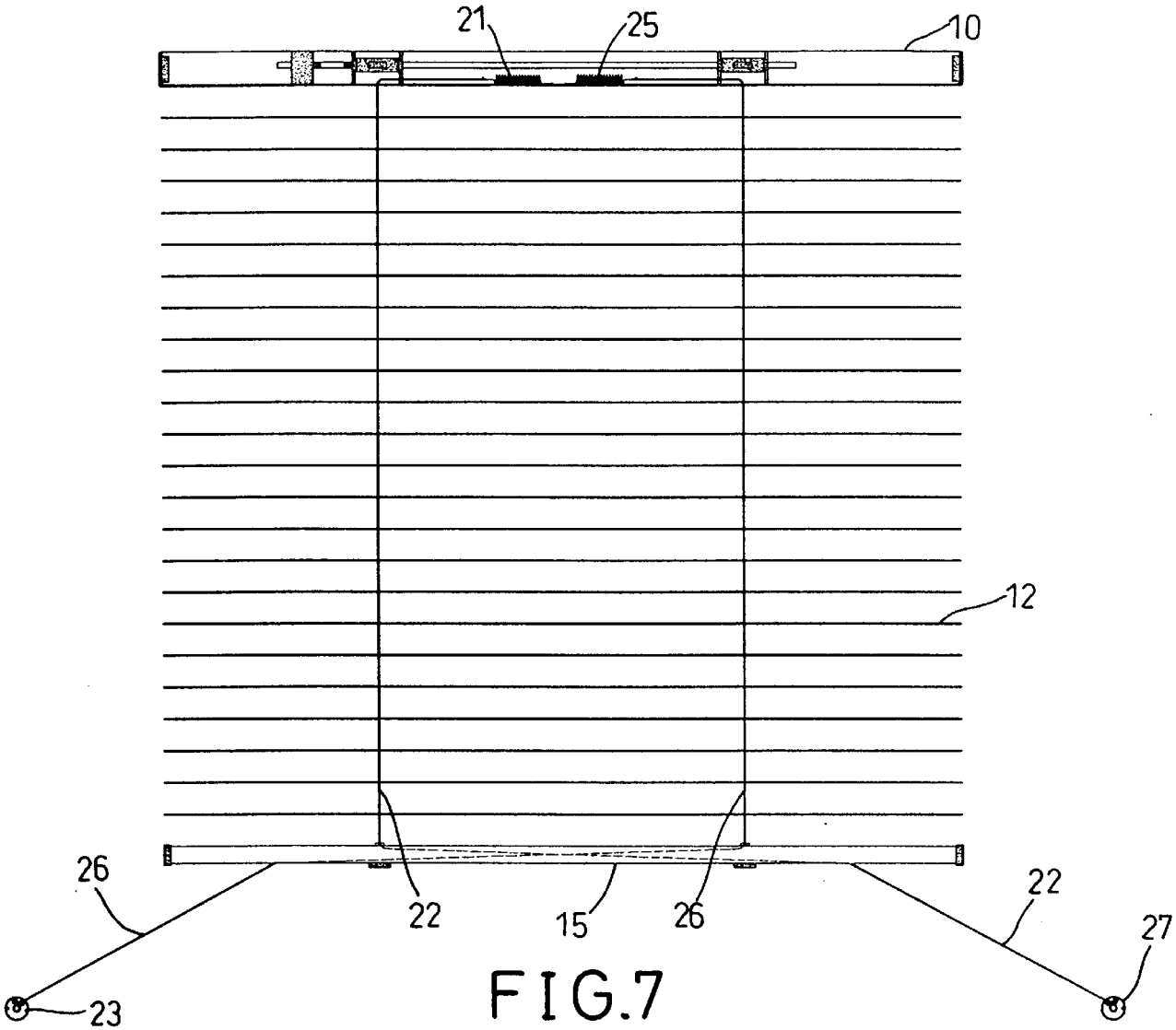
FIG. 7 is a front plan view of the tension lift device in accordance with another embodiment of the present invention.

Referring to FIG. 7, in accordance with another embodiment of the present invention, the second end of the first retaining cord (22) extends outward from a mediate portion of the second end of the bottom rail (15), and the second end of the second retaining cord (26) extends outward from a mediate portion of the first end of the bottom rail (15).

Figure 8:
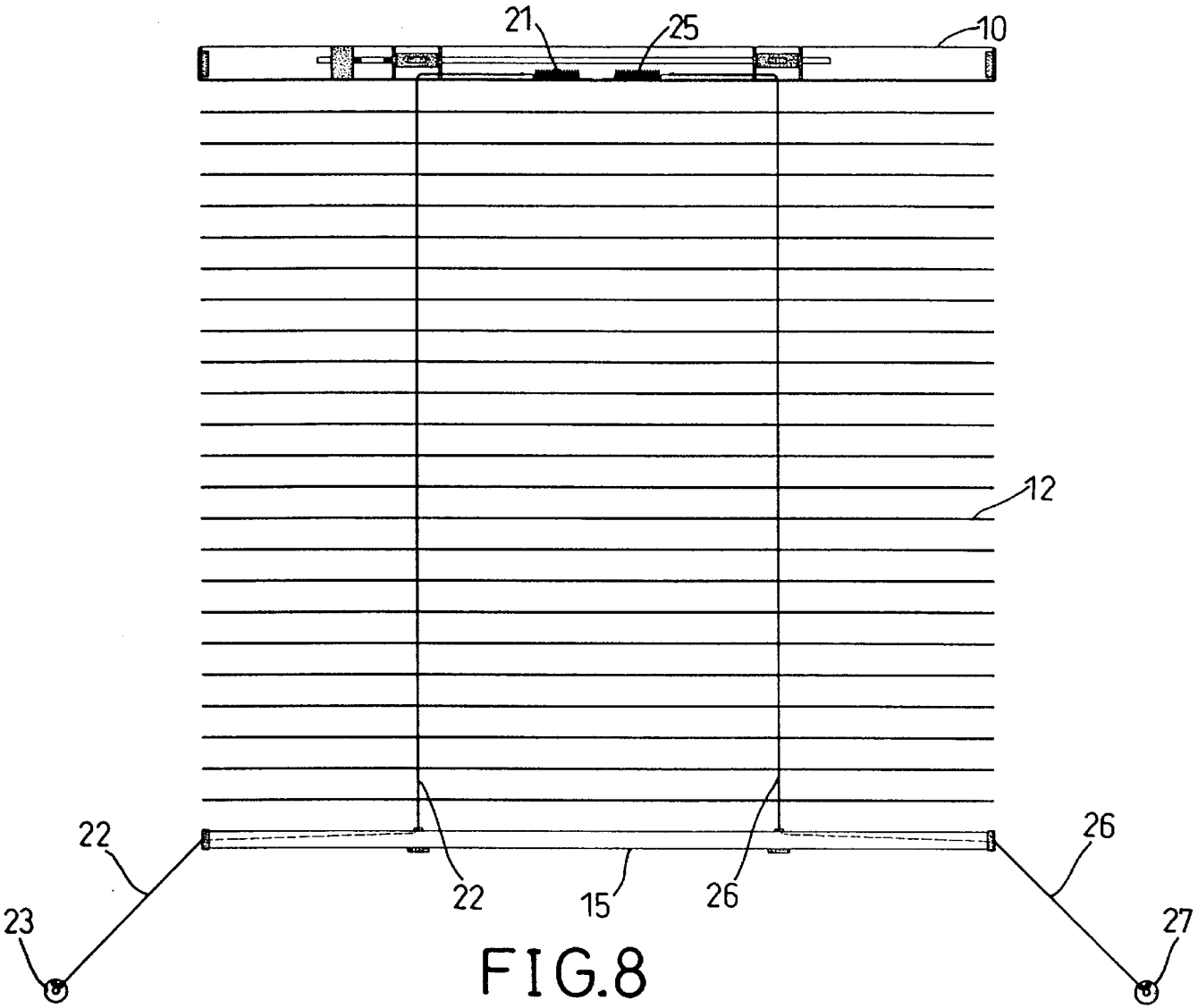
FIG. 8 is a front plan view of the tension lift device in accordance with a further embodiment of the present invention.

Referring to FIG. 8, in accordance with a further embodiment of the present invention, the second end of the first retaining cord (22) extends outward from the first end of the bottom rail (15), and the second end of the second retaining cord (26) extends outward from the second end of the bottom rail (15).

Figure 9:
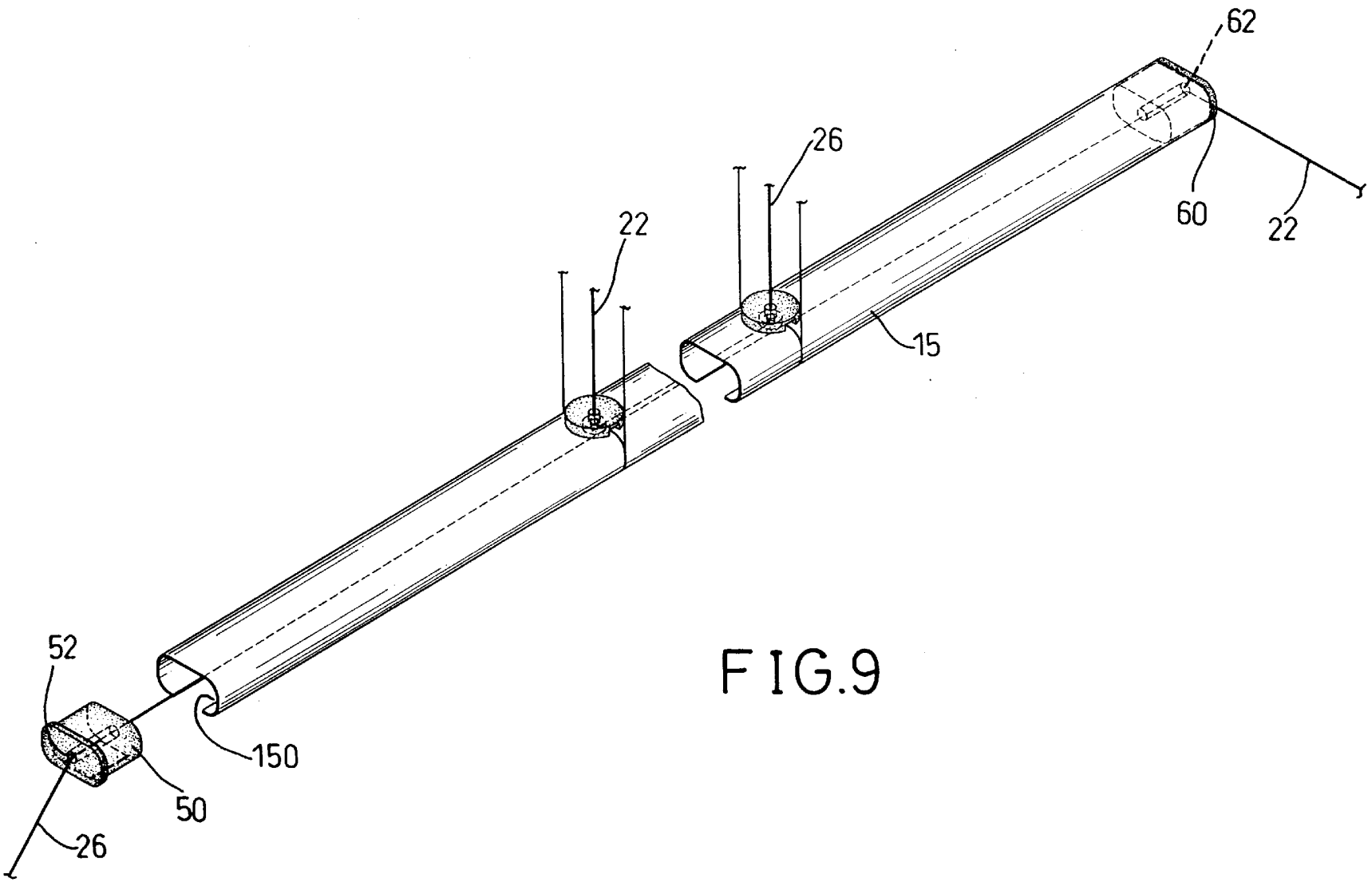
FIG. 9 is an exploded perspective view of the tension lift device in accordance with a further embodiment of the present invention.
Figure 10:
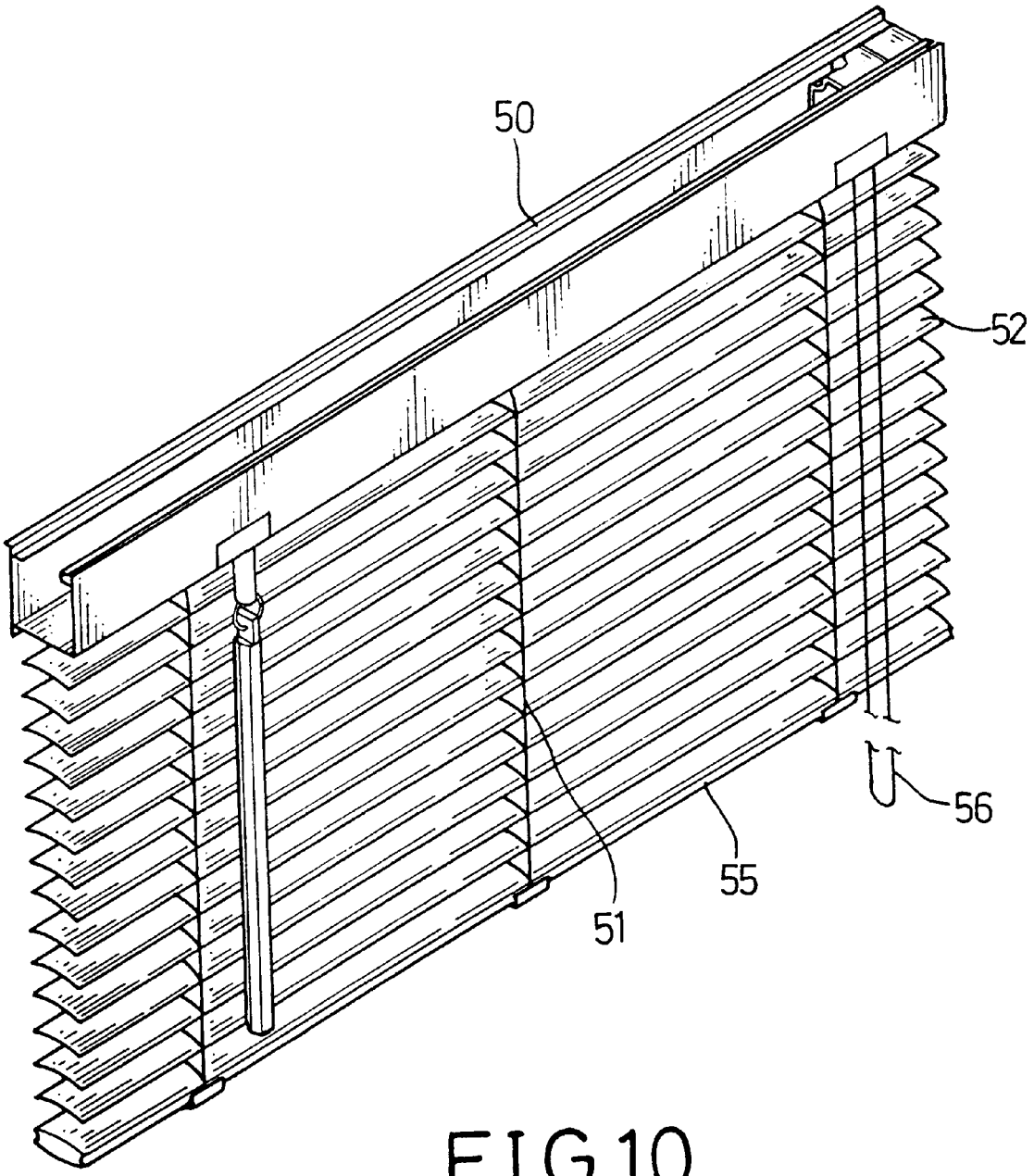
FIG.10 PRIOR ART
FIG. 10 is a perspective view of a conventional Venetian blind in accordance with the prior art.

Referring to FIG. 9, in accordance with a further embodiment of the present invention, the bottom rail (15) contains an elongated channel (150) longitudinally defined through the periphery thereof and having a first end and a second end, and the tension lift device further comprises a first plug (50) detachably attached to the first end of the bottom rail (15) and containing a first hole (52) to allow passage of the second end of the second retaining cord (26), and a second plug (60) detachably attached to the second end of the bottom rail (15) and containing a second hole (62) to allow passage of the second end of the first retaining cord (22). The first plug (50) and the second plug (60) can be detached from the bottom rail (15) to release the first retaining cord (22) and the second retaining cord (26) from the whole blind through the channel (150), thereby facilitating a user cutting the bottom rail (15) at its two ends so as to fit the whole blind to the required dimension.

It should be clear to those skilled in the art that further embodiments may be made without departing from the scope of the present invention.

What is claimed is:

1. A tension lift device for a venetian blind, said venetian blind comprising a headrail (10), a plurality of slats (12), and a bottom rail (15), said tension lift device comprising:

a first retaining cord (22) extending through each of said slats (12) and having a first end secured in said headrail (10), and a second end extending through said bottom rail (15) and extending outward from said bottom rail (15);

a second retaining cord (26) extending through each of said slats (12) and having a first end secured in said headrail (10), and a second end extending through said bottom rail (15) and extending outward from said bottom rail (15); and a first fastening reel (23) secured to said second end of said second retaining cord (26), and a second fastening reel (27) secured to said second end of said first retaining cord (22).

2. The tension lift device in accordance with claim 1, wherein said first fastening reel (23) contains a first axial hole (232) therein, and said second fastening reel (27) contains a second axial hole (272) therein.

3. The tension lift device in accordance with claim 1, wherein said first fastening reel (23) includes a first tapered retaining lug (24) extending outward from the periphery thereof, and said second fastening reel (27) includes a second tapered retaining lug (28) extending outward from the periphery thereof.

4. The tension lift device in accordance with claim 1, further comprising a first biasing member (21) having a first end secured in said headrail (10), and a second end secured to said first end of said first retaining cord (22).

5. The tension lift device in accordance with claim 4, further comprising a second biasing member (25) having a first end secured in said headrail (10), and a second end secured to said first end of said second retaining cord (26).

6. The tension lift device in accordance with claim 1, wherein said second end of said first retaining cord (22) extends in said bottom rail (15) in the direction opposite to that of said second end of said second retaining cord (26).

7. The tension lift device in accordance with claim 6, wherein said bottom rail (15) has a first end and a second end, said second end of said first retaining cord (22) extends outward from said second end of said bottom rail (15), and said second end of said second retaining cord (26) extends outward from said first end of said bottom rail (15).

8. The tension lift device in accordance with claim 7 wherein said second end of said first retaining cord (22) extends outward from a mediate portion of said second end of said bottom rail (15), and said second end of said second retaining cord (26) extends outward from a mediate portion of said first end of said bottom rail (15).

9. The tension lift device in accordance with claim 6, wherein said bottom rail (15) has a first end and a second end, said second end of said first retaining cord (22) extends outward from said first end of said bottom rail (15), and said second end of said second retaining cord (26) extends outward from said second end of said bottom rail (15).

10. The tension lift device in accordance with claim 1, wherein said bottom rail (15) contains an elongated channel (150) longitudinally defined through the periphery thereof and having a first end and a second end, and said tension lift device further comprises a first plug (50) detachably attached to said first end of said bottom rail (15) and containing a first hole (52) therein, and a second plug (60) detachably attached to said second end of said bottom rail (15) and containing a second hole (52) therein, whereby, said first plug (50) and said second plug (60) can be detached from said bottom rail (15) to release said first retaining cord (22) and said second retaining cord (26) from said whole blind through said channel (150), thereby facilitating a user cutting said bottom rail (15) at its two ends so as to fit said whole blind to the required dimension.

* * * * *